United States Patent [19]

Schmidt et al.

[11] Patent Number: 5,075,178

[45] Date of Patent: Dec. 24, 1991

[54] BLACK SURFACE LAYER ON LIGHT METAL

[75] Inventors: Juergen Schmidt; Thomas Furche; Roland Erdmann; Marion Reichert; Bayer Ullrich, all of Jena; Peter Kurze, Oberlichtenau; Thomas Schwarz, Karl-Marx-Stadt; Joachim Schreckenbach, Limbach-Oberfrohna; Hans-Jüergen Kletke, Karl-Marx-Stadt; Andreas Hofmann, Karl-Marx-Stadt; Martin Heppner, Jena; Anja Hasse, Berlin; Dorith Schmidt, Jena; Annette Klaus, Jena, all of Fed. Rep. of Germany

[73] Assignee: Jenoptik Jena GmbH, Jena, Fed. Rep. of Germany

[21] Appl. No.: 638,288

[22] Filed: Jan. 7, 1990

Related U.S. Application Data

[62] Division of Ser. No. 528,664, May 24, 1990, Pat. No. 5,035,781.

[30] Foreign Application Priority Data

Jul. 19, 1989 [DD] German Democratic Rep. ... 331003
Jul. 19, 1989 [DD] German Democratic Rep. ... 331004

[51] Int. Cl.[5] ..... B32B 15/20
[52] U.S. Cl. ..... 428/660; 428/661
[58] Field of Search ..... 428/660, 661

[56] References Cited

U.S. PATENT DOCUMENTS

| | | | |
|---|---|---|---|
| 3,268,306 | 8/1966 | Jefferys | 428/661 |
| 3,446,606 | 5/1969 | Friedrich et al. | 428/661 X |
| 4,305,998 | 12/1981 | Manty et al. | 428/661 |
| 4,448,853 | 5/1984 | Fischer et al. | 428/661 X |

*Primary Examiner*—Donald R. Valentine
*Attorney, Agent, or Firm*—Jordan and Hamburg

[57] ABSTRACT

The invention relates to a cyanide-free electrolyte being harmless to the environment and to health which makes feasible the production of black surface layers on light metals or on alloys of the latter, preferably titanium, remaining deeply-black and adhesive even after extreme changes in the ambient temperature and having nearly equal values of the optical absorptivity of radiation and of the thermal emission capability (the $\alpha/\epsilon$-ratio is about 0.95) by means of the anodic oxidation by spark discharge (ANOF-method). These layers are absolutely X-amorphous and show, hence, an ideal optically isotropic behavior regarding the reflection of radiation. Due to their minmum evolution of gases they offer a high thermovacuum stability. The electrolyte consists of an ammoniacal solution of $K_2H_2PO_4$ potassium dihydrogenphosphate and $K_2CrO_4$ potassium chromate. The homogeneity of the optically black layers is ensured by not using fluoride ions and employing acetate ions. Such layers comprise titanium, chromium and copper in ratios of Cr:Ti=1: (1.9 to 2.2) and Cr:Cu=1:(0.8 to 1.3).

2 Claims, No Drawings

BLACK SURFACE LAYER ON LIGHT METAL

This is a division, of application Ser. No. 07/528,664, filed May 24, 1990 now U.S. Pat. No. 5,035,781.

BACKGROUND OF THE INVENTION

The present invention relates to electrolytes for the evolution of black finely dulled surface layers destined for working surfaces of modules consisting of light-weight material, especially titanium material, by applying the method of the anodic oxidation by spark discharge (ANOF-method). These electrolytes are long-term stable and the modules coated with them will guarantee an optimal application under specific operational conditions as well. From specialist and patent literature there is known a variety of electrolytes for coating light-weight material with surface layers by means of anodic oxidation by spark discharge, especially for coating metals with a unipolar conductivity, such as Ti, Ta, Zr, Nb or Al. In the DD-patent specification No. 221 762 and the DD patent specification No. 229 163 black or grey-black surface layers on light metals, such as Al, produced by means of the ANOF-method are described. It is a disadvantage of these solutions that electrolyte solutions are applied which do contain, in particular, fluorides in the form of NaF or $NH_4F$ besides dihydrogenphosphate as $NaH_2FO_4$, besides tetraborates in the form of dehydrated borax $Na_2B_4O_7$ and besides chromates or different admixtures. The feasibility of inserting non-metallic (carbides, oxides) or metallic components by means of fluoride-containing, ANOF-method produced electrolytes as dispersing layers on titanium material as it is described in the DD-patent specification No. 156 003, involves, apart from the disadvantageous presence of fluorides in the electrolyte, the disadvantage of a slight solubility of the components within the electrolyte and all the other disadvantages typical for dispersing layers as an inhomogeneous structure or the like. The opportunity of blackening is not described therein. The DD-patent specification No. 257 275 refers to decorative coatings, e.g. on titanium material, which are produced by means of applying the ANOF-procedure and an electrolyte consisting of NaF, $NaH_2FO_4$, $Na_2B_4O_7$ and potassium hexacyanoferrate (II) $K_4[Fe(ON)_6]$. This solution involves the complex problem of environmental and health protection because the electrolyte employed has a toxic activity and is cyanide-containing. The black color is achieved merely by applying the hexacyanoferrate (II) which forms a titanium spinel which is simular to the black Fe-Al-spinel and merely satisfies decorative requirements.

Moreover, a number of black layers on materials, in particular on metals with a unipolar conductivity, such as Ti, Ta, Zr, Nb, Al, are known the radition-physical quantities of which—the optical absorption ($\alpha$) and the thermal emission ($\epsilon$)—have nearly equal values.

On the one hand, we have the opportunity of simply black-dying the surfaces of the solar collectors and, this way, to obtain a layer having the properties indicated above. On the other hand, it is as well feasible to employ diverse types of lakes to produce black layers with a $\alpha/\epsilon$-ratio of about 1. It is a disadvantage of this solution that does not yield a finely-dulled layer. Additionally an especially problematic circumstance is the relatively high loss in weight of the lakes due to the release of volatile components. After being exposed to 125° C. and $10^{-5}$ Torr over a time period of 24 hours the weight loss amounts to 3–5.4% for lakes which are currently usual. According to the standard ASTM E 595-77 the maximum weight loss due to the minimum release of volatile components amounts to 1% after being exposed to 125° C. and $10^{-5}$ Torr for 24 hours. Currently, there is no lake coating which meets these requirements. Hence, no other lacquer system ensures a thermovacuum stability.

The DD-patent specification No. 236 978 describes absorption layers consisting of dark colored, chromium-doped oxide layers on metals with a unipolar such as Ti, Ta, Zr, Nb, Al, and which, as well, are produced by a fluoride-containing electrolyte including dihydrogenphosphate, tetraborate, and chromate, applying the ANOF-procedure. Such layers, on the one hand, will have a high absorptivity of radiation of $\alpha > 0.92$ but on the other hand, they show, unfortunately, a surface structure of such a roughness to cause multiple reflections so that the incident radiation will transmit its energy in the form of heat to the absorption layer and the heat is, in turn, transferred to the collector body. In comparison with the optical absorption $\alpha$ there is achieved only a low thermal emission $\epsilon$.

SUMMARY OF THE INVENTION

It is an object of the present invention to obviate the above disadvantages. It is another object of the invention to provide a cost-saving electrolyte with only a small content of harmful substances for producing simply built up, optically black, finely dulled surface layers on light metals or the alloys thereof, especially on titanium, having a very good long-term stability and being universally applicable.

It is a further object of the present invention to develop a both fluoride- and cyanide-free electrolyte which makes feasible the production of optically black layers having equal values of the optical absorptivity and the thermal emission capability combined with a high stability and, at the same time, a good thermovacuum stability.

DETAILED DESCRIPTION OF THE INVENTION

These and other objects are realized with an electrolyte for the production of black surface layers on light metals or alloys thereof, preferably titanium, by means of an anodic oxidation by spark discharge (ANOF-method) characterized in that the electrolyte consists of a 2 to 6 per cent by volume ammoniacal aqueous solution of 0.3 to 0.6 mole/liter potassium dihydrogenphosphate; 0.08 to 0.3 mole/liter potassium chromate and acetate ions in concentrations of 0.08 to 0.5 mole/liter. A preferable solution is to employ copper acetate as acetate ions. An essential result of using the electrolyte according to the present invention is the feasibility of producing black surface layers on light metals or alloys thereof, preferably titanium, by means of employing said electrolyte, the surface layers having nearly similar values of the optical absorptivity of radiation and of the thermal emission capability, comprising titanium, chromium and copper in the ratios of Cr:Ti=1:(1.9 to 2.2) and Cr:Cu=1:(0.8 to 1.3) and having a high thermovacuum stability. The advantages of the present solution are due to the electrolyte according to the invention which:

is cyanide-free and, consequently, harmless to health and environment;

ensures the homogeneity of the black layers by not employing fluoride-ions and applying acetate-ions;

and due to a layer system according to the invention;

which has a finely-dulled surface structure and, as a result, in contrast to the state-of-the-art chromium-doped oxide layers on metals with an unipolar conductivity, has both nearly equal values of the optical absorptivity and thermal emission capability, which is totally X-amorphous, i.e. the coherent scattering regions are smaller than 4 nm. This results in an ideal optically isotropic behavior of said layers concerning the reflection of the radiation at a maximum absorptivity of the incident radiation.

which has a good adhesive strength even after being exposed to temperature changes which makes feasible a very good thermovacuum stability combined with a high long-term stability due to a minimum release of volatile components of the layer system. This way phenomena of contamination occuring on the modules, e.g. in optical systems, and affecting the operation can be excluded.

which layer system is, at the same time, preferably characterized by a high UV-resistance, and which, hence, guarantees an optimum application under special operational conditions as well.

The invention will be illustrated by the following specific example, it being understood that there is no intention to be necessarily limited by any details therof since variations can be made within the scope of the invention.

EXAMPLE OF EMBODIMENT

An objective housing of Ti-material being degreased with industrially produced acetone is coated by means of a plasma-chemical anodic oxidation in an aqueous electrolyte consisting of a 4.5 per cent by volume ammoniacal solution containing 0.5 mole/liter $KH_2PO_4$; 0.1 mole/liter $K_2CrO_4$ and 0.35 mole/liter $[CH_3COO]_2Cu$ at a current density of 0.045 $A.cm^{-2}$. With a single-stage process is yielded a deeply-black colored surface layer which remains adhesive on the objective even after temperature changes. Said layer has a finely-dulled surface structure and, as a result, in contrast to the state-of-the-art solutions nearly equal values of the optical absorptivity and the thermal emission capability. The $\alpha/\epsilon$-ratio is 0.95.

Since the employing of fluoride-ions is entirely avoided and acetate ions are used for the electrolyte a completely homogeneous, optically black layer is produced. This surface layer is totally X-amorphous and offers, hence, an ideal optically isotropic behavior concerning the reflection of the radiation. Furthermore, it is characterized by a maximum absorptivity of $\alpha=0.96$. The already known values disclosed in specialist literature are in between 0.89 and 0.95. Investigations with respect to thermovacuum stability do not reveal any changes in optically relevant ranges. Contaminations of the optical systems affecting the operation are excluded due to the extremely low release of volatile components causing a weight loss of $\leqq 0.03\%$ after the layer has been exposed to 125° C. and $10^{-5}$ Torr for 24 hours. The weight loss indicated in international standard regulations is about 1%, the values obtained up to now being 3 to 5%. Tests of the UV-resistance of the coated objective material do not reveal any changes of the emission behavior after the material has been exposed to intensive, simulated sun light for 56 days.

What is claimed is:

1. A black surface layer on a light metal or on an alloy thereof, the layer having nearly equal values of optical absorptivity of radiation and thermal emission capability and a high thermovacuum stability and consisting essentially of titanium, chromium and copper in the ratios Cr:Ti=1:(1.9 to 2.2) and Cr:Cu=1:(0.8 to 1.3).

2. A black surface layer according to claim 1, in which the light metal is titanium.

* * * * *

UNITED STATES PATENT AND TRADEMARK OFFICE

CERTIFICATE OF CORRECTION

PATENT NO. : 5,075,178

DATED : December 24, 1991

INVENTOR(S) : Juergen SCHMIDT et al

It is certified that error appears in the above-identified patent and that said Letters Patent is hereby corrected as shown below:

ON THE TITLE PAGE

At Item 22, the filing date, change "Jan. 7, 1990" to --Jan. 7, 1991--.

At Item 75, the fifth inventor's name should be --Ullrich Bayer--, instead of "Bayer Ullrich"; and The ninth inventor's name should be --Hans-Juergen Kletke--, instead of "Hans-Jüergen Kletke".

Signed and Sealed this

Seventeenth Day of March, 1992

*Attest:*

HARRY F. MANBECK, JR.

*Attesting Officer*

*Commissioner of Patents and Trademarks*